US006694693B2

(12) United States Patent
Alderman

(10) Patent No.: US 6,694,693 B2
(45) Date of Patent: Feb. 24, 2004

(54) INSULATION BLOCK FOR ROOF STRUCTURE

(76) Inventor: Robert J. Alderman, 686 Highland Ter., Canyon Lake, TX (US) 78133

( * ) Notice: Subject to any disclaimer, the term of this patent is extended or adjusted under 35 U.S.C. 154(b) by 0 days.

(21) Appl. No.: 10/094,924

(22) Filed: Mar. 11, 2002

(65) Prior Publication Data

US 2003/0167718 A1 Sep. 11, 2003

(51) Int. Cl.[7] ..... E04B 9/00; E06B 3/54

(52) U.S. Cl. ..... 52/478; 52/749.12; 52/745.16; 52/407.5; 52/404.3

(58) Field of Search ..... 52/483.1, 478, 52/749.12, 745.06, 407.1, 407.5, 404.3

(56) References Cited

U.S. PATENT DOCUMENTS

| | | | | | |
|---|---|---|---|---|---|
| 2,674,354 | A | * | 4/1954 | MacLeod | 52/478 |
| 3,559,914 | A | | 2/1971 | Alderman | 242/86.52 |
| 3,969,863 | A | | 7/1976 | Alderman | 52/407 |
| 4,047,345 | A | | 9/1977 | Alderman | 52/404 |
| 4,047,346 | A | * | 9/1977 | Alderman | 52/407 |
| 4,058,949 | A | * | 11/1977 | Bellem | 52/407 |
| 4,075,806 | A | * | 2/1978 | Alderman | 52/407 |
| 4,147,003 | A | | 4/1979 | Alderman | 52/309.8 |
| 4,172,345 | A | * | 10/1979 | Alderman | 52/407 |
| 4,222,212 | A | * | 9/1980 | Alderman | 52/749.12 |
| 4,329,823 | A | * | 5/1982 | Simpson | 52/478 |
| 4,446,665 | A | * | 5/1984 | Berger | 52/478 |
| 4,566,239 | A | * | 1/1986 | Smigel et al. | 52/407 |
| 4,642,961 | A | * | 2/1987 | Cruise | 52/404.3 |
| 4,736,552 | A | * | 4/1988 | Ward et al. | 52/478 |
| 5,561,959 | A | * | 10/1996 | Alderman | 52/478 |
| 5,918,436 | A | * | 7/1999 | Alderman | 52/407.5 |

* cited by examiner

*Primary Examiner*—Carl D. Friedman
*Assistant Examiner*—Nahid Amiri
(74) *Attorney, Agent, or Firm*—Thomas, Kayden, Horstemeyer & Risley

(57) ABSTRACT

A heat block (28) is positioned between the upper lateral flange (24) of a purlin (14) and the roof panel (16) supported by the purlin. The heat block is in the shape of a barbell in that it includes opposed side portions (33 and 34) that are sized and shaped to extend laterally beyond the purlin (14) out into the hot zone adjacent the upper portion of the purlin and the roof panel (16). The heat block is of greater stiffness than the adjacent blanket insulation so that the heat block reliably occupies the space in the hot zone. Phase change material (64) can be incorporated in the opposed side portions (33 and 34) of the heat block.

37 Claims, 5 Drawing Sheets

INSULATION BLOCK FOR ROOF STRUCTURE

FIELD OF THE INVENTION

This invention involves heat insulation for the roofs of industrial buildings about the purlins and roof panels supported by the purlins. More particularly, this invention provides a heat block in the hot zone about the purlins of an industrial building.

BACKGROUND OF THE INVENTION

Heat insulation material placed in walls, ceilings, roofs, and floors of building structures typically comprise fibrous blanket insulation, such as elongated blankets formed of fiberglass or other fibrous materials. The principle of the insulation blanket is to form dead air spaces between the fibers that provide insulation against convection and conduction heat transfer. The blanket insulation can be formed in small "clumps" of fibrous material and blown into spaces such as into the attics of residential homes and other building structures. The fibrous insulation also can be made into elongated blankets formed in a specific width and depth that is suitable for placement between parallel joists, studs, rafters, and other parallel support structures that are uniformly spaced apart. The elongated blanket, such as a fiberglass blanket, is cut to the desired length at the job site for placement between the parallel structures. Also, a sheet of facing material usually is applied to one broad surface of the insulation blanket, with the facing material having overhanging edges or "tabs" extending beyond the sides of the blanket that can be applied by the installer to adjacent studs, joists, purlins, etc. of the building structure to hold the blanket in place.

Fiberglass is one of the most desirable materials for forming blanket insulation because it holds its shape and traps a substantial amount of air between its fibers to form the dead air spaces. However, the fiberglass alone does not provide adequate heat insulation against radiant heat transfer.

With regard to industrial buildings of the type having exposed rafters and purlins that support the outside roof sheets, blanket insulation can be applied with the lengths of the blanket extending parallel to the purlins and with the blankets positioned in the spaces between the purlins. It is desirable to have the blankets fill all of the available space between the purlins, but the upper laterally extending flange of the typical Z-shaped purlin or of the typical I-shaped purlin tends to compress or crush portions of the blanket adjacent the purlins, so that some of the air is forced out of the blanket and the heat insulation capacity of the blanket is reduced. This is referred to herein as a "hot zone."

Another problem with the prior art blanket insulation of industrial building is the radiant heat transmitted through the roof structure. Fiberglass insulation does not form an effective radiant heat reflector so as to insulate against radiant heat transmission through the roof structure. U.S. Pat. No. 5,918,436 discloses the concept of installing radiant heat reflective sheets between adjacent purlins in a roof structure of an industrial building, so as to provide the desired radiant heat insulation to the structure. Also, in the recent past, an additional sheet of reflective material has been applied to one of the broad surfaces of the fibrous insulation blanket for radiant heat reflection. The reflective material, such as aluminum foil, functions as a barrier to radiant heat transfer. However, the use of the reflective material does not adequately solve the problem of insulating the hot zone about the purlins.

Another problem with the prior art insulation for industrial buildings is that the roof panels that form the outside surface of the roof usually makes direct contact with the upper laterally extending flange of the purlin, or is insulated therefrom with inadequate insulation, providing heat transfer from the roof panels to the purlin, and then to the inside of the building.

This invention concerns the above noted problems.

SUMMARY OF THE INVENTION

Briefly described, the present invention comprises an improved heat insulation assembly for placement in, and for becoming a part of, an industrial building of the type that includes a plurality of equally spaced parallel purlins supporting roof panels, with these materials being made of steel, aluminum or other metals. The heat insulation assembly can insulate the building from conduction, convection and radiation heat transfer through the roof structure of the building.

While this invention disclosure is specifically directed toward the heat insulation of a roof structure, it will be understood that the same principles of the invention can be applied to walls, floors, ceilings, and virtually any type of enclosure in which the temperature, humidity and other aspects of the environment are controlled inside the building but the exterior temperature and humidity remain uncontrolled and typically the temperature moves to levels higher than and lower than the interior temperature.

In the disclosed embodiments of the invention, a feature of the invention is an insulation heat block that is positioned between the purlins and the roof panels, with the heat block extending laterally beyond the purlins into the hot zone adjacent the purlins. The heat blocks each include a central body that rests upon the purlin and side portions that extend laterally beyond the central body for extending out into the space adjacent the purlins, so as to fill the hot zone adjacent the purlins with insulation of known value. This configuration of the side portions moves any crushed blanket insulation away from the purlins or fills any vacant space adjacent the purlins, and assures that known insulation value will be provided by the heat block directly adjacent the purlins and between the purlins and the roof panels.

Another feature of this invention is the use of insulation blankets that are positioned between adjacent purlins. The blankets include opposed side edges having conductive heat insulation formed therein for placement between the upper flange of the purlins and the roof panels for the purpose of insulating against conductive heat transfer through the roof. The insulated edges of the blankets are manufactured with and become a part of the insulation blanket before the blanket reaches the roof structure, so that the blanket with its insulated edges can be installed in a single operation. The insulated edges of the blankets can be formed of strips of air cell blanket, strips of fiberglass or of other fibrous materials, or other suitable conduction heat insulation material.

The insulation blankets extending between adjacent purlins can be formed of, for example, fiberglass blanket, air cell blanket, heat reflective sheets, or a combination thereof.

Another feature of this invention is the use of radiant heat reflective sheets that extend between adjacent ones of the purlins for the purpose of reflecting radiant heat and for insulating the roof structure from heat transfer due to radiation. The radiant heat reflective sheets perform best when the reflective surfaces are maintained in a clean state and are positioned away from adjacent objects so as to provide a clear or "dead air" space immediately adjacent the reflective surfaces, thereby maintaining their capacity to reflect radiant heat.

Other features of the invention will become apparent upon reading the following specification, when taken in conjunction with the accompanying drawings.

DETAILED DESCRIPTION

Figure 1:
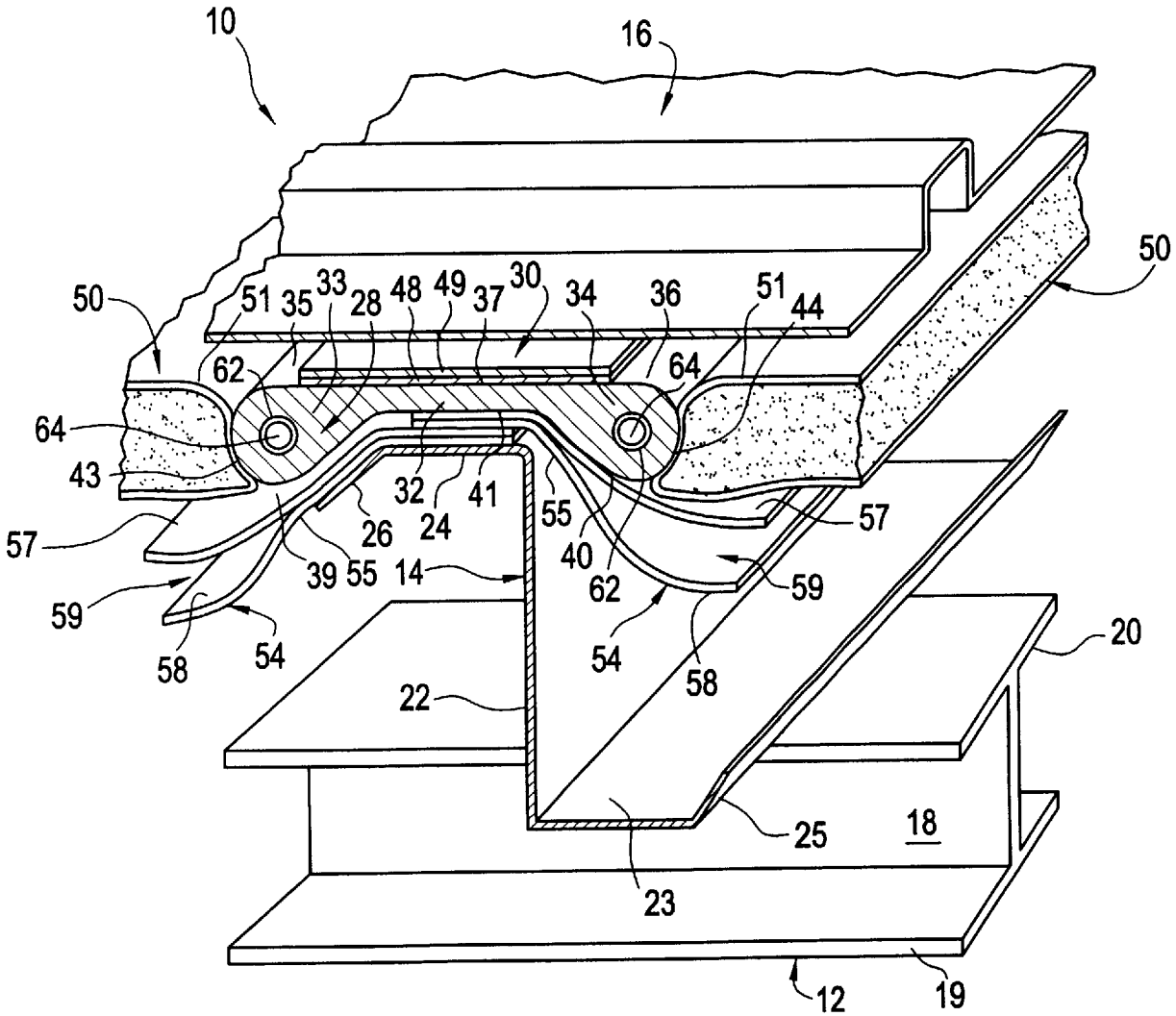
FIG. 1 is a perspective illustration, in cross section, of a roof structure embodying the heat block, radiant heat reflective blanket, and fiberglass blanket, together with a thermal block board.
Figure 2:
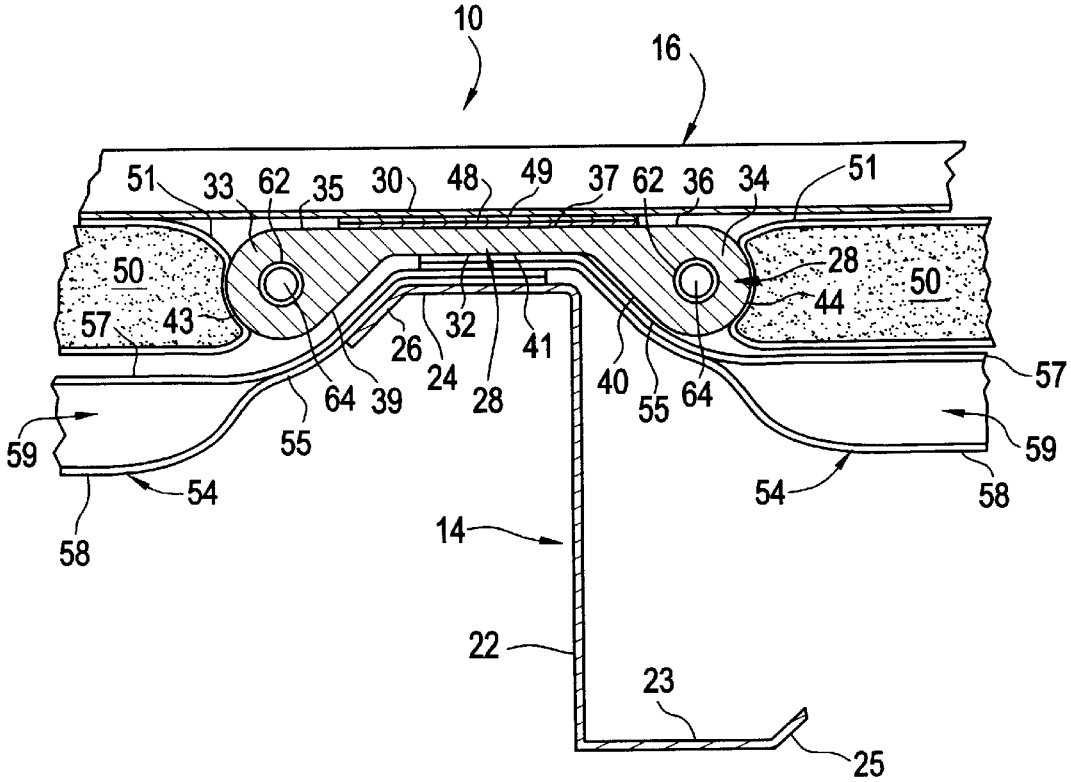
FIG. 2 is a cross sectional view of the structure of FIG. 1.

Referring now in more detail to the drawings in which like numerals indicate like parts throughout the several views, FIGS. 1 and 2 illustrate a portion of a roof structure for an industrial building 10 which includes a plurality of rectilinear, parallel rafters 12, a plurality of rectilinear, parallel purlins 14 that extend normal to the rafters, and roof panels 16 mounted on the rafters 14.

The rafters 12 are conventional I-beams each having a central web 18, and lower and upper transverse flanges 19 and 20. Purlins 14 are of conventional design, including a central web 22, and oppositely extending, opposed lower and upper lateral flanges 23 and 24, with the distal edges 25 and 26 of the flanges sloped with respect to the central body portions of the flanges 23 and 24. The lower lateral flange 23 of each purlin rests on the rafters 12 and the upper lateral flange 24 supports the roof panels 16.

Interposed between the purlins 14 and roof panels 16 are heat blocks 28 and thermal block boards 30. Heat blocks 28 are rectilinear and extend along the length of the purlins, with the typical length being two to three feet, depending on the size of the roof panels to be applied to the roof . The heat blocks are shaped in cross section similar to a half bar bell or a saddle, having a central body 32 that is of a width that corresponds to the width of the lateral flange 24 of the purlin, so as to rest in flat abutment against the lateral flange 24, and opposed side portions 33 and 34 that extend laterally from the central body 32 and slope downwardly into the hot zone adjacent the purlin. Preferably, the opposed side portions are of greater thickness than the central body 32. The upper surfaces 35 and 36 of the opposed side portions 33 and 34 are substantially coextensive with the upper surface 37 of the central body 32 so as to extend adjacent to roof panels, while the lower surfaces 39 and 40 of the opposed side portions slope downwardly from the lower surface 41 of the central body 32 to extend into the hot zone. The distal surfaces 43 and 44 of the opposed side portions 33 and 34 are rounded.

With this shape, the heat block 28 completely covers the upper lateral flange 24 of the purlin 14, and the opposed side portions 33 and 34 of the heat block 28 extend on opposite sides of the purlin toward the areas that are occupied by other insulation materials, such as fiberglass blanket, reflective sheet blanket, air cell blanket, or other heat insulation materials. Preferably, the side portions of the heat block fill the hot zones adjacent the sides of the purlin.

The heat block 28 is formed of expanded foam, such as polystyrene or cyanoacrylate, which have high R-values. The polystyrene heat block is formed of material that has a higher K value, heat resistance per linear inch, than fiber glass, and is more rigid than the fiberglass and any of the other insulation materials that are likely to be used between the purlins, such as fiberglass blanket, air cell blanket, etc. This assures that when the blanket insulation has been installed and the heat block is being installed, the heat block will displace the edges of the less rigid fiberglass, etc. pushing it out of its way. This assures that a low K value is established in the hot zone and that the K value is uniformly established and maintained in the vicinity about the upper portion and sides of the purlin, particularly between the purlin and the roof panels 16.

Figure 3:
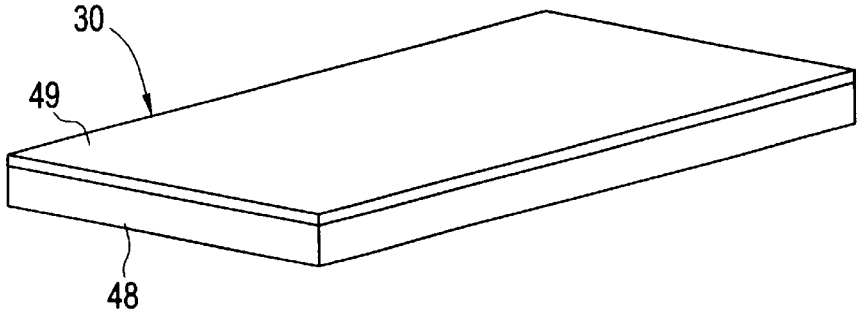
FIG. 3 is a perspective view of the thermal block board.
Figure 4:
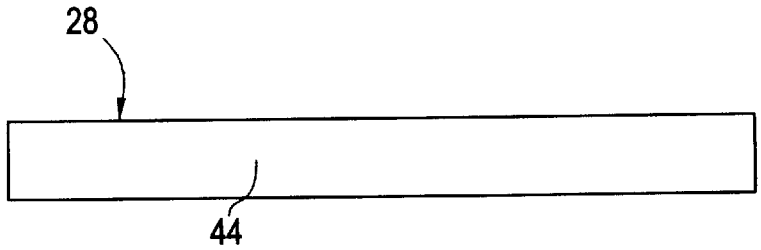
FIG. 4 is a side view of the heat block.

In order to protect the shape of the heat block 28 when the roof panels 16 are being installed, the thermal block boards 30 are applied to the central body 32 of the heat blocks. The thermal block boards can be formed of extruded polystyrene when a standing seam roof is being applied. When the roof is to have roof panels that screw down onto the purlins, the polystyrene thermal block boards are so soft that there is a hazard of too much movement of the roof panels with respect to the purlins and therefore a hazard of developing leaks in the roof. As illustrated in FIG. 3, the thermal block boards 30 can be formed of a laminate, for example of ¾ inch thick polystyrene board 48 and ¼ inch thick plywood board 49 positioned adjacent the roof panels.

Typically, the width of the thermal block board 30 will wider than the width of the upper flange 24 of the purlin. In this embodiment the width of the thermal block boards is approximately four inches, which is sufficient to span beyond the dimensions of the lateral flange 24 of the typical purlin used in this environment. The thermal block board functions to spread the force applied by the roof panels 16 and the fasteners (not shown) across a broad surface of the heat block and across the entire upper surface of the upper lateral flange of the purlin. For a screw down roof, a fastener can be driven downwardly through the roof panel 16, through the plyboard 49 and polystyrene 48 of the thermal block board 30, through the heat block 28, and through the upper lateral flange 24 of the purlin 14, to mount the roof panels to the purlins. This forms a sandwich of materials on the purlin and presses the ply board 49 against the lower surface of the roof panels 16, providing a firm surface against which the roof panels will rest, thereby resisting movement between the roof panels and the structure below due to expansion and contraction from changes in temperature.

Fiberglass blankets 50 are positioned between adjacent ones of the purlins and the heat blocks are installed after the blankets with the side edges 51 of the blankets engaging the opposed side portions 33 and 34 of the heat block 28. The thermal block boards 30 are then mounted on the heat blocks and the roof panels applied to the roof as previously described.

If desired, a radiant heat reflective blanket 54 is suspended between the purlins. The blanket 54 has side edges or seams 55 that are supported by the purlins. The blankets are formed of two layers of heat reflective sheet material, such as aluminum foil. The details of the construction and performance of the radiant heat reflective blanket 54 is described in U.S. Pat. No. 5,918,436, which is incorporated herein by reference. In general, the heat reflective sheets 57 and 58 are arranged in overlying relationship and are extended along the length of the building structure, parallel to the purlins 14. The lower heat reflective sheet 58 is of greater width and cross sectional area than the upper heat reflective sheet 57, so that it tends to sag to a lower level than sheet 57, thereby forming a dead air space or gap 59 between the sheets 57 and 58. The dead air space protects the interior heat reflective surfaces of the sheets 57 and 58 from accumulating fibers, dust, dirt or moisture, thereby protecting the reflective properties of the sheets. In addition, by enclosing the inner reflective surfaces of the heat reflective sheets, the inner surfaces will not engage any other objects, thereby maintaining space at the reflective surfaces so that no objects will block or diminish the reflectivity of the heat reflective sheets.

Figure 5:
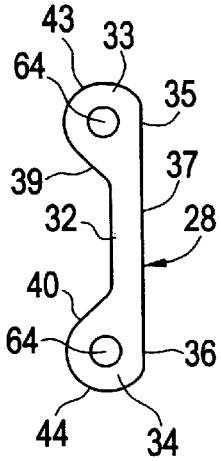
FIG. 5 is an end view of the heat block.
Figure 6:
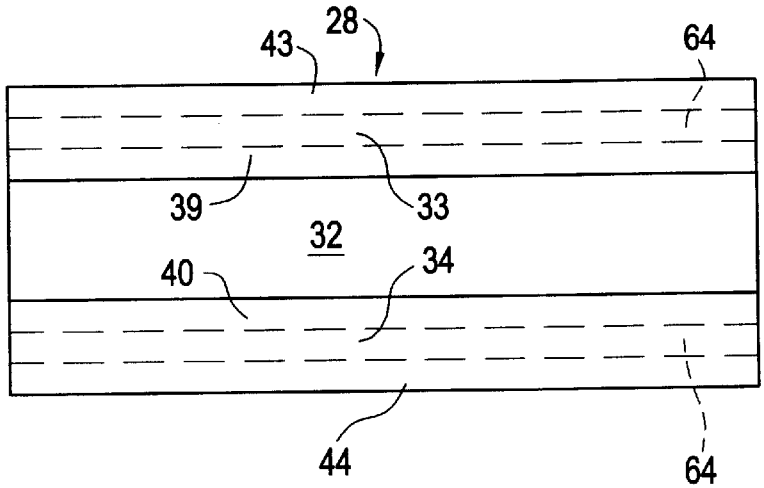
FIG. 6 is a bottom view of the heat block.

Heat block 28 can also include phase change material ("PCM") that helps insulate against the transfer of heat across the roof structure. As shown in FIGS. 1, 2 and 5, a liquid impermeable tube 62 is extended along the length of each opposed side portion 33 and 34 of the heat block. The tubes 62 are sealed at their ends and define an elongated container 64 in which PCM is contained. The PCM changes phases between solid and liquid in response to the changes in temperature of the PCM. For example, suitable phase change materials are: sodium sulfate decahydrate that has a solid/liquid phase change temperature of about 90 degrees F., calcium chloride that has a solid/liquid phase change temperature of about 80 degrees F., and paraffin that has a phase change temperature of about 80 degrees F.

When the temperature of the heat block rises from a level below the phase change temperature of the PCM, so that the PCM begins to change from solid state to liquid state, a substantial amount of heat is absorbed in the change of phase of the PCM, requiring heat to cause the PCM to change phases. Thus, the PCM, while absorbing heat during its change of phase, retards the transfer of heat across the roof structure.

Likewise, when the outside temperature falls from above to below the phase change temperature of the PCM, the reverse condition occurs, in that the PCM requires the subtraction of heat in order to transform from liquid to solid, thereby avoiding a drop in temperature of the roof structure. A more detailed explanation of the use of PCM in this type of an environment is found in my U.S. Pat. Nos. 5,626,936 and 5,770,295, which are incorporated herein by reference.

Figure 7:
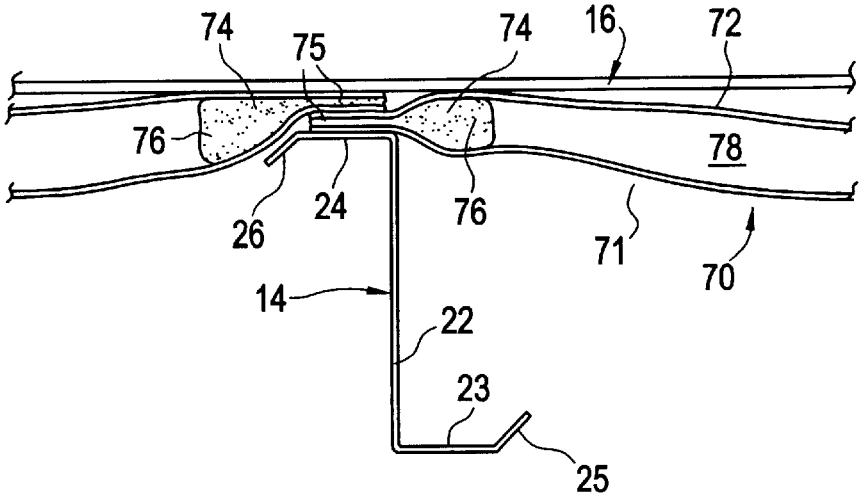
FIG. 7 is a cross sectional view of a purlin and the heat reflective blanket with fiberglass blanket edge strips.
Figure 8:
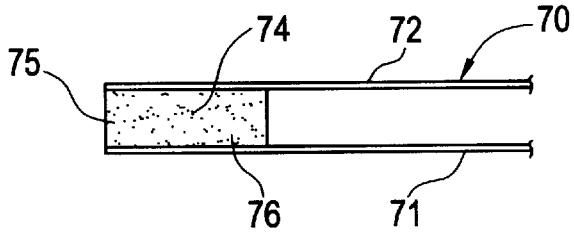
FIG. 8 is a partial end cross sectional view of the heat reflective blanket with edge strips, before the edge strips of the blanket have been compressed and installed in the roof structure.

FIGS. 7 and 8 show another embodiment of the invention. A radiant heat reflective blanket 70 includes a pair of overlying reflective sheets 71 and 72, having their opposed side edges also in overlying relationship, with fiberglass blanket strips 74 positioned therebetween. The fiberglass blanket strips at the side seams of the reflective sheets are adhered to the facing surfaces of the reflective sheets, and are positioned between the upper lateral flange 24 of the purlin 14 and the roof panel 16. The force applied by the roof panel 16 to the purlin 14 tends to somewhat crush and reduce in size the blanket strips 74. However, the portions of the blanket strips 74 that extend beyond the purlins 14 into the space between the purlins is not reduced in size and tends to maintain its shape. This places insulation of substantially known value at the junction of the purlins with the roof panels 16, so that the normally hot zone about the upper surfaces of the purlins and the adjacent portion of the roof panels is adequately insulated with insulation of known value.

In the meantime, the proximal portions 76 of the blanket strips 74 hold the overlying edge portions of the radiant heat reflective sheets 71 and 72 apart, assuring that a dead air space 78 is maintained between the reflective sheets.

Figure 9:
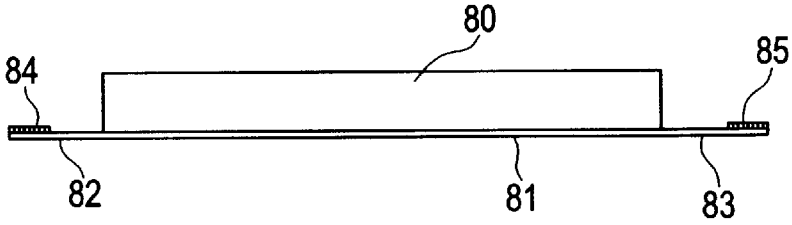
FIG. 9 is an end cross sectional view of the fiberglass blanket with edge tabs including air cell blanket edge strips.
Figure 10:
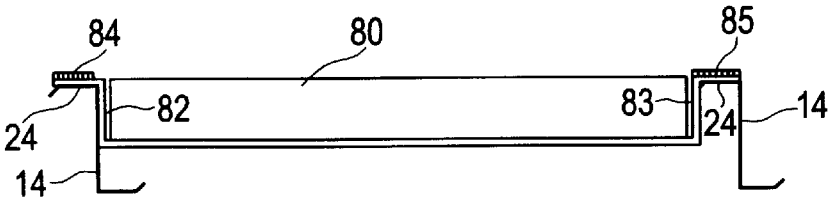
FIG. 10 is an end cross sectional view, similar to FIG. 9, of a fiberglass blanket with a cell blanket edge strip, showing the blanket in position on adjacent purlins.

FIGS. 9 and 10 show another embodiment of the invention, in which a fiberglass blanket 80 has a facing sheet 81 applied to one broad surface. The facing sheet, formed of polypropylene or polyethylene or other suitable material, has flexible side flanges or tabs 82 and 83 that extend laterally beyond the blanket, and cell blanket strips 84 and 85 are adhered to the tabs 82 and 83. The tabs and strips are configured so that when the fiberglass blanket 80 is placed in a roof structure of an industrial building, the tabs 82 and 83 will fold upwardly about the side edges of the blanket 80 and the cell blanket strips 84 and 85 will be laid upon the upper surface of the upper lateral flange 24 of the purlin. The roof panels (not shown in these figures) is then applied to the purlins in the usual manner. This places the cell blanket strips 84 and 85 between the roof panels and the purlins.

Figure 11:
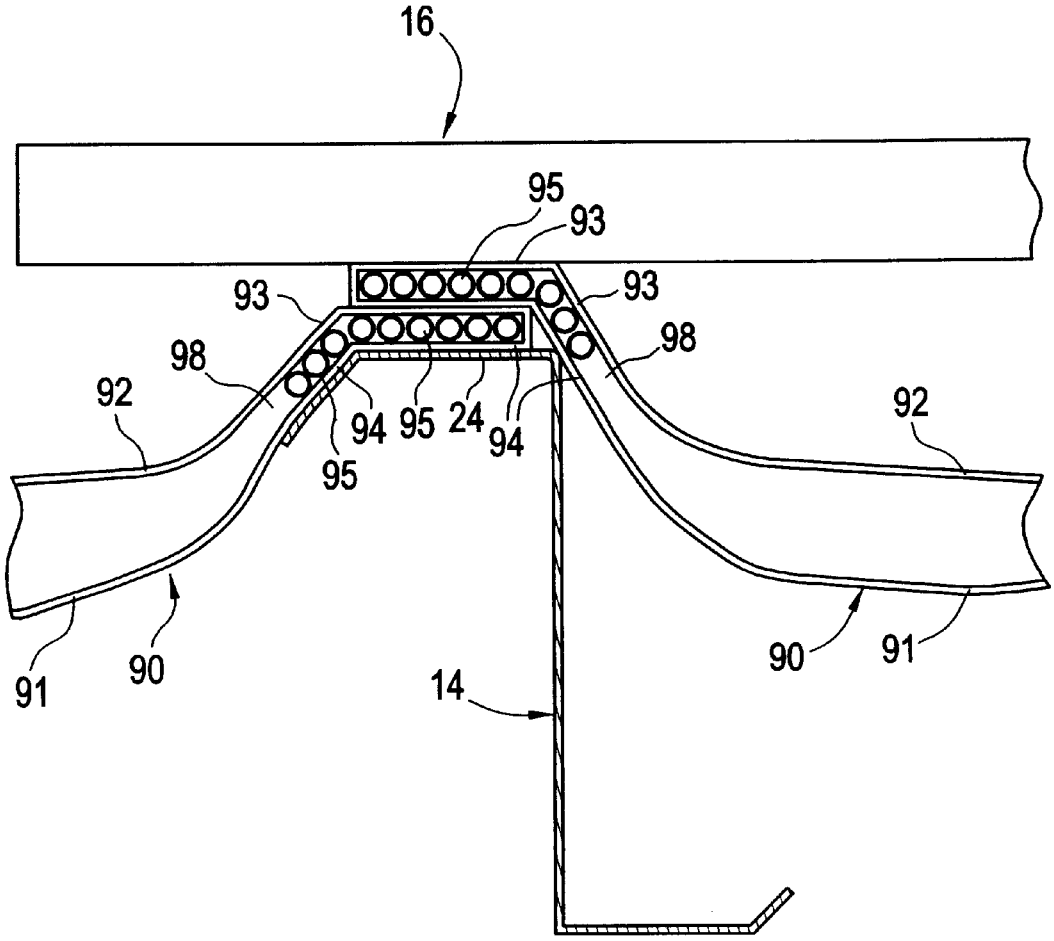
FIG. 11 is an end cross sectional view of the adjacent portions of fiberglass blankets with cell blanket edge strips mounted on a purlin in a roof structure.

FIG. 11 shows another embodiment of the invention, and is similar to that of FIGS. 7 and 8, but substitutes cell blanket strips for the fiberglass blanket strips. The radiant heat reflective blanket includes reflective sheets 91 and 92 that are suspended between adjacent ones of the purlins 14. The blankets have overlying edge portions 93 and 94, with a cell blanket strip 95 interposed therebetween. The cell blanket strips 95 are placed on the upper surface of the upper lateral flange 24 of the purlin, between the purlin and the roof panel 16. The cell blanket strips therefore support the radiant heat reflective blanket 90 and provide conductive heat insulation between the purlin 14 and the roof panel 16.

If desired, a layer of phase change material is positioned in the radiant heat reflective blanket 90, between the cell blanket strip and the main body portion of the blanket, adjacent the upper lateral flange 24. As before, the PCM present in the blanket absorbs heat as it is transformed from its solid state to its liquid state, and gives up heat as it is transformed from its liquid state to its solid state. This further insulates the hot spot around the upper portion of the purlins.

The heat block 28 of FIGS. 1, 2 and 4–6, the fiberglass blanket strips 74 of the radiant heat reflective blanket 70, and the cell blanket strips 84, 85 and 95 all function as heat blocks, in that they provide heat insulation at the hot zone about the upper portion of the purlins, particularly in the space between the surfaces of the purlins and the surface of the roof panels, as well as in the hot zone adjacent the purlins.

Although preferred embodiments of the invention have been disclosed in detail herein, it will be obvious to those skilled in the art that variations and modifications of the disclosed embodiments can be made without departing from the spirit and scope of the invention as set forth in the following claims.

I claim:

1. A structural heat insulator assembly, for placement in a roof of an industrial building having a plurality of elongated parallel support purlins facing the interior of the building structure and adjacent roof panels mounted to said purlins and facing the exterior of the building, for insulating the building from the transfer of heat through the roof, said structural heat insulator assembly comprising:

at least two longitudinal sheets formed from a flexible material, said longitudinal sheets each including opposed side edges arranged in overlying relationship for mounting to adjacent ones of the parallel purlins for suspending said longitudinal sheets between adjacent ones of said purlins, one of said sheets having a greater surface area than the other of said sheets for forming a dead air gap between said sheets and enhancing the insulation value of the heat insulator assembly, and elongated heat blocks for positioning between the purlins and the roof panels and for extending along the purlins and protruding laterally from the purlins into the space between the purlins, said heat blocks extending parallel to said opposed side edges of said longitudinal sheets, a rigid board positioned on said heat block and facing said roof panels and pressed against the lower surface of tie roof panels whereby fasteners can penetrate through the roof panels and the rigid board and rigidly connect the roof panels to the rigid board.

2. The structural heat insulator assembly of claim 1, wherein at least one of said longitudinal sheets is formed of heat reflective material facing said dead air gap.

3. The structural heat insulator of claim 2, wherein said heat blocks are formed from the materials selected from the group consisting of: expanded foam, an air cell blanket, fiberglass, wood, and laminated board.

4. A structural heat insulator assembly, for placement in a roof of an industrial building having a plurality of elongated parallel support purlins facing the interior of the building structure and adjacent roof panels mounted to said purlins and facing the exterior of the building, for insulating the building from the transfer of heat through the roof, said structural heat insulator assembly comprising:

at least two longitudinal sheets formed from a flexible material, said longitudinal sheets each including opposed side edges arranged in overlying relationship for mounting to adjacent ones of the parallel purlins for suspending said longitudinal sheets between adjacent ones of said purlins, one of said sheets having a greater surface area than the other of said sheets for forming a dead air gap between said sheets and enhancing the insulation value of the heat insulator assembly, elongated heat blocks for positioning between the purlins and the roof panels and for extending along the purlins and protruding laterally from the purlins into the space between the purlins, said heat blocks extending parallel to said opposed side edges of said longitudinal sheet; and a laminated board positioned adjacent said heat blocks comprising a laminate of plywood for facing the roof panel and expanded polystyrene facing said heat block, whereby fasteners can penetrate through the roof panels and rigidly connect to the plywood.

5. A structural heat insulator assembly, for placement in a roof of an industrial building having a plurality of elongated parallel support purlins facing the interior of the building structure aid adjacent roof panels mounted to said purlins and facing the exterior of the building, for insulating the building from the transfer of heat through the roof, said structural heat insulator assembly comprising:

at least two longitudinal sheets formed from a flexible material, said longitudinal sheets each including opposed side edges arranged in overlying relationship for mounting to adjacent ones of the parallel purlins for suspending said longitudinal sheets between adjacent ones of said purlins, one of said sheets having a greater surface area tan the other of said sheets for forming a dead air gap between said sheets and enhancing the insulation value of the heat insulator assembly, elongated heat blocks for positioning between the purlins and the roof panels and for extending along the purlins and protruding laterally from the purlins into the space between the purlins, said heat blocks extending parallel to said opposed side edges of said longitudinal sheets, and wherein said heat block is in the cross sectional shape of a saddle with a narrow central body and opposed side portions of greater thickness than said central body.

6. A structural heat insulator assembly for placement in a roof of an industrial building having a plurality of elongated parallel support purlins facing the interior of the building structure and adjacent roof panels mounted to said purlins and facing the exterior of the building, for insulating the building from the transfer of heat through the roof, said structural heat insulator assembly comprising:

at least two longitudinal sheets formed from a flexible material, said longitudinal sheets each including opposed side edges arranged in overlying relationship for mounting to adjacent ones of the parallel purlins for suspending said longitudinal sheets between adjacent ones of said purlins, one of said sheets having a greater surface area than the other of said sheets for forming a dead air gap between said sheets and enhancing the insulation value of the heat insulator assembly, elongated heat blocks for positioning between the purlins and the roof panels and for extending along the purlins and protruding laterally from the purlins into the space between the purlins, said heat blocks extending parallel to said opposed side edges of said longitudinal sheets, and wherein said opposed side portions of said heat block include phase change material selected from the group consisting of: sodium sulfate decahydrate, calcium chloride, and paraffin.

7. The structural heat insulator of claim 1, wherein said opposed side portions of said heat block extend to one side of said central body, for straddling a purlin of the roof.

8. The structural heat insulator of claim 1, wherein said phase change material is positioned in said opposed side portion of said heat block.

9. The structural heat insulator assembly of claim 1, wherein at least one of said longitudinal sheets is formed of metal foil.

10. A roof structure comprising:

a plurality of rafter oriented in spaced parallel relationship with respect to one another, a plurality of purlins supported by said rafters in spaced parallel relationship with respect to one another and extending across said rafters, said purlins each having a laterally extending upper flange, roof panels supported by said upper flanges of said purlins, a layer of conductive heat insulation material positioned between the facing surfaces of each of said laterally extending upper flanges of said purlins and said roof panels to inhibit the transfer of conductive heat between said purlins and said roof panels, said insulation material supporting phase change material that changes between liquid and solid, and said phase change material selected from the group consisting essentially of sodium decahylrate, calcium chloride and paraffin.

11. The roof structure of claim 10, and further including a pair of elongated overlying sheets connected at opposed edges forming a dead air space therebetween and supported at their edges by the purlins.

12. The roof structure of claim 11, wherein at least one of said pair of elongated overlying sheets is formed from the group consisting of: expanded foam, air cell blanket, and fiberglass.

13. Structural heat insulator assemblies for placement between the purlins facing the interior of a building and the roof panels mounted on the purlins and facing the exterior of the building, for insulating the building from the transfer of heat between the purlins and the roof panels, comprising:

heat blocks each having an elongated central body for mounting on a purlin and having opposed side portions for extending beyond said central body and shaped for straddling the purlins and aligning said heat blocks on the purlins, a board having a flat surface engaging said central body of said heat block for positioning between said heat block and the roof panels, and said board comprising a laminate of ply wood facing said roof panel and expanded polystyrene for facing the purlin, whereby fasteners can fasten the roof panels to the board.

14. The structural heat insulator assembly of claim 13, wherein said opposed side portions of said heat block are of greater thickness than said central body.

15. The structural heat insulator assembly of claim 13, wherein said heat block is fabricated of expanded foam.

16. The structural heat insulator assembly of claim 13, wherein said central body of said heat block has opposed flat surfaces, one of said flat surfaces for engagement with a purlin and the other of said flat surfaces for engagement with a roof panel.

17. The structural heat insulator assembly of claim 13, wherein said opposed side portions of said heat block include phase change material.

18. The structural heat insulator assembly of claim 13, and further including a radian heat reflective sheet extending between said heat blocks of the adjacent ones of said purlins.

19. The structural heat insulator assembly of claim 13, and further including a pair of overlying radiant heat reflective sheets extending between adjacent ones of said heat blocks.

20. The structural heat insulator assembly of claim 19, wherein the surface area of one of said radiant heat reflective sheets is larger than the surface area of the other radiant heat reflective sheet.

21. The structural heat insulator assembly of claim 20, wherein said pair of overlying radiant heat reflective sheets define there between a dead air space.

22. The structural heat insulator assembly of claim 18, wherein said radiant heat reflective sheet is formed of metal foil.

23. The structural heat insulator of claim 18, and further including a layer of fiberglass blanket insulation positioned between said radiant heat reflective sheet and the purlin.

24. In a roof structure of an industrial building comprising:

a plurality of elongated parallel purlins each having a central web and upper and lower flanges extending in opposite lateral directions from the upper and lower portions of said central web, roof panels supported by said upper flanges of said purlins, the improvement therein of:

insulation blankets positioned between and substantially filling the spaces between adjacent ones of said purlins and compressed at the spaces adjacent said upper flanges of said purlins, heat blocks formed of heat insulation material of greater rigidity Ohm said insulation blankets mounted on said purlins, and each said heat block formed in cross section in a substantially saddle shape and including a central body and opposed side portions being of greater thickness than said central body, said central body sized and shaped to cover the upper flange of a purlin and said side portions extending beyond its purlin into said space adjacent said purlin substantially filling the space on opposite sides of the upper flange of the purlins.

25. A heat block for placement between a purlin and roof panels of a roof structure, comprising:

a central body having upper and lower surfaces with said upper surface sized and shaped for engagement with a roof panel and said lower surface sized and shaped for engagement with the upper surface of a purlin, opposed side portions extending from said central body of greater thickness than said central body and including a sloped portions for straddling a purlin and extending into space on opposite sides of a purlin.

26. The heat block of claim 25, wherein said heat block is formed of material selected from the group consisting of: foamed polystyrene and foamed cyanoacrylate.

27. The heat block of claim 25, wherein said heat block is monolithic.

28. The heat block of claim 25, wherein said opposed side portions include phase change material that changes between liquid and solid.

29. The heat block of claim 25, wherein said opposed side portions of said heat block are configured to extend into the hot zone adjacent a purlin of a roof structure.

30. The heat block of claim 25, wherein said heat block is formed of a material that is more rigid than and has a higher K value than fiberglass insulation blanket.

31. A process of insulating an industrial building having roof panels supported by a plurality of parallel side-by-side purlins comprising:

installing blanket material between adjacent ones of the purlins, placing heat blocks on the purlins with enlarged side portions of the heat blocks sloped downwardly into the spaces on opposite sides of and straddling the purlins and displacing the blanket material at the sides of the purlins, mounting roof panels on the heat blocks, and attaching the roof panels through the heat blocks to the purlins.

32. The process of claim 31, and further including the step of:

placing thermal block boards of greater rigidity than said heat blocks on said heat blocks, and wherein the step of mounting roof panels on the heat blocks comprises mounting the roof panels on the thermal block boards, and wherein the step of attaching the roof panels through the heat blocks to the purlins comprises attaching the roof panels through the thermal block boards and the heat blocks to the purlins.

33. The process of claim 31, wherein the step of installing insulation material between the purlins comprises installing heat insulation blankets formed from material selected from the group consisting of: fiberglass, air cells, expanded foam, radiant heat barrier sheets, and heat reflective sheets.

34. The process of claim 31, wherein the step of placing heat blocks on said purlins comprises installing heat blocks formed of material tat is more rigid than the blanket material, and wherein the step of displacing the blanket material at the sides of the purlins comprises pushing the blanket material away from the purlin with the heat blocks.

35. In a roof of an industrial building having a plurality of elongated parallel support purlins facing the interior of the building structure, each said purlin having an upper surface, and adjacent roof panels supported on the upper surfaces of said purlins and facing the exterior of the building, the improvement therein comprising:

elongated heat blocks for positioning between the purlins and the roof panels and for extending along the upper surfaces of the purlins, said heat blocks including phase change material that changes between liquid and solid said phase change material selected from the group consisting essentially of foamed polystyrene and foamed cyanoacrylate.

36. The invention of claim 35, wherein said elongated heat blocks each have a central body sized and shaped for engagement with the upper surface of a purlin and opposed side portions extending away from said purlins, said phase change material positioned in said opposed side portions.

37. The invention of claim 35, wherein said phase change material is selected from the group consisting essentially of: sodium sulfate decahydrate, calcium chloride, and paraffin.

* * * * *